US009570039B2

(12) United States Patent
Shie et al.

(10) Patent No.: US 9,570,039 B2
(45) Date of Patent: Feb. 14, 2017

(54) DISPLAY DEVICE, DRIVING METHOD OF DISPLAY DEVICE AND DATA PROCESSING AND OUTPUTTING METHOD OF TIMING CONTROL CIRCUIT

(71) Applicant: Fitipower Integrated Technology, Inc., Hsinchu (TW)

(72) Inventors: Wen-Shian Shie, Hsinchu (TW); Tung-Shuan Cheng, Hsinchu (TW)

(73) Assignee: Fitipower Integrated Technology, Inc., Hsinchu (TW)

( * ) Notice: Subject to any disclaimer, the term of this patent is extended or adjusted under 35 U.S.C. 154(b) by 285 days.

(21) Appl. No.: 14/140,563

(22) Filed: Dec. 26, 2013

(65) Prior Publication Data

US 2014/0184574 A1 Jul. 3, 2014

(30) Foreign Application Priority Data

Dec. 27, 2012 (TW) ..... 101150633 A

(51) Int. Cl.
*G09G 5/00* (2006.01)
*G09G 3/36* (2006.01)

(52) U.S. Cl.
CPC ..... *G09G 5/008* (2013.01); *G09G 3/3611* (2013.01); *G09G 3/3688* (2013.01); *G09G 2330/06* (2013.01); *G09G 2370/08* (2013.01)

(58) Field of Classification Search
None
See application file for complete search history.

(56) References Cited

U.S. PATENT DOCUMENTS 8,884,934 B2 * 11/2014 Jeon ..... G09G 3/20 345/204
8,947,412 B2 * 2/2015 Jeon ..... 345/204
2001/0015712 A1 * 8/2001 Hashimoto ..... G09G 3/3688 345/92
2004/0227716 A1 * 11/2004 Lin ..... G09G 3/3648 345/99
2007/0216630 A1 * 9/2007 Liao ..... G09G 3/20 345/100

(Continued)

FOREIGN PATENT DOCUMENTS

JP 10-149136 A 6/1998
JP 2001-282165 A 10/2002

(Continued)

*Primary Examiner* — Seokyun Moon
(74) *Attorney, Agent, or Firm* — ScienBiziP, P.C.

(57) ABSTRACT

A display device includes a timing control circuit and a data driving circuit. The data driving circuit receives the first clock embedded training data from the timing control circuit, performs a first clock training to adjust a work frequency of the data driving circuit to be equal to the frequency of a first clock signal, and receives the first clock embedded image data from the timing control circuit. The data driving circuit also receives a second clock embedded training data from the timing control circuit, performs a second clock training to adjust a work frequency of the data driving circuit to be equal to the frequency of a second clock signal, and receives the second clock embedded image data from the timing control circuit. The frequency of the first clock signal is different from a frequency of the second clock signal.

17 Claims, 5 Drawing Sheets

(56) References Cited

U.S. PATENT DOCUMENTS

| | | | | |
|---|---|---|---|---|
| 2008/0246755 | A1* | 10/2008 | Lee | G09G 3/20 345/214 |
| 2009/0051675 | A1* | 2/2009 | Huang | G06F 1/12 345/204 |
| 2011/0242066 | A1* | 10/2011 | Jeon | G09G 3/20 345/204 |
| 2014/0184582 | A1* | 7/2014 | Shie | G09G 3/20 345/213 |

FOREIGN PATENT DOCUMENTS

| | | | |
|---|---|---|---|
| JP | P2004-333809 | A | 11/2004 |
| JP | P2005-316050 | A | 11/2005 |
| JP | 2010-204667 | A | 9/2010 |
| JP | 2011-513790 | A | 4/2011 |
| JP | 2011-514560 | A | 5/2011 |
| JP | 2011-221487 | A | 11/2011 |
| JP | 2012-142941 | A | 7/2012 |

* cited by examiner

DISPLAY DEVICE, DRIVING METHOD OF DISPLAY DEVICE AND DATA PROCESSING AND OUTPUTTING METHOD OF TIMING CONTROL CIRCUIT

CROSS-REFERENCE TO RELATED APPLICATIONS

This application is related to an US patent application with Ser. No. 12/140,564 and entitled "DISPLAY DEVICE, DRIVING METHOD OF DISPLAY DEVICE AND DATA PROCESSING AND OUTPUTTING METHOD OF TIMING CONTROL CIRCUIT", and claims a foreign priority on an application filed in Taiwan on Dec. 27, 2012, with Serial No. 101150639. These related applications are incorporated herein by reference.

BACKGROUND

1. Technical Field

The present disclosure relates to a display device, a driving method of the display device, and a data processing and outputting method of a timing control circuit.

2. Description of Related Art

Display devices usually include many integrate circuits with different functions, such as timing control circuits, data driving circuits, gate driving circuits and so on. Generally, these integrate circuits need transmit data between each other. However, due to high work frequencies of the integrate circuits, electromagnetic interference (EMI) during data transmission has become more serious.

What is needed is to provide a means that can overcome the above-described limitations.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Reference will now be made to the drawings to describe certain exemplary embodiments of the present disclosure in detail.

Figure 1:
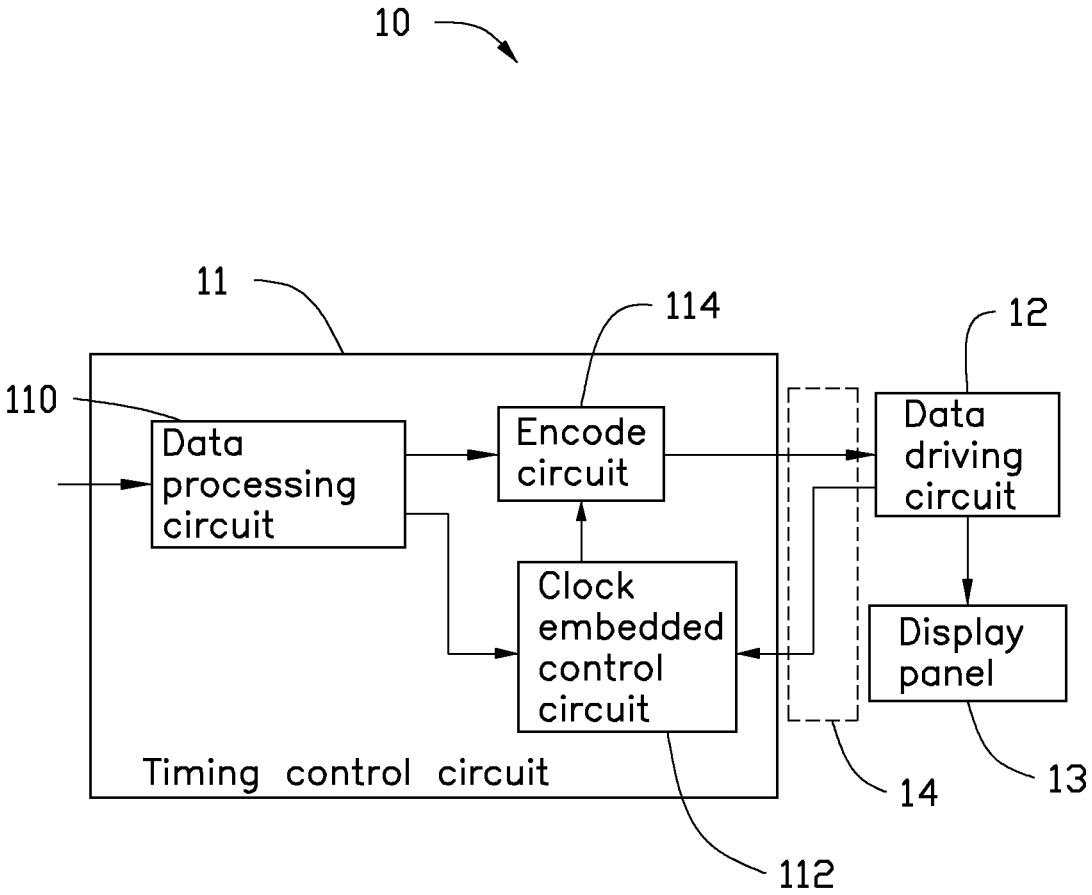
FIG. 1 is a block diagram of a display device according to an exemplary embodiment of present disclosure.

FIG. 1 shows a block diagram of a display device according to an exemplary embodiment of present disclosure. The display device 10 includes a timing control circuit 11, a data driving circuit 12, and a display panel 13. The timing control circuit 11 includes a data processing circuit 110, an encode circuit 114, and a clock embedded control circuit 112. The data processing circuit 110 is electrically connected to the encode circuit 114 and the clock embedded control circuit 112. The encode circuit 114 is electrically connected to the data driving circuit 12. The clock embedded control circuit 112 is electrically connected to the encode circuit 114. The data driving circuit 12 is electrically connected to the display panel 13. A data transmission interface 14 is defined between the timing control circuit 11 and the data driving circuit 12, such that the timing control circuit 11 transmits data to the data driving circuit via the data transmission interface 14. In one embodiment, the data transmission interface 14 is a clock embedded point to point interface. Each of the timing control circuit 11 and the data driving circuit 12 can be an integrate circuit. The display panel 13 can be a liquid crystal display panel.

The data processing circuit 110 receives display data from an external circuit (such as a scale controller) and decodes the display data to obtain a reference clock signal, a first data signal, and a second data signal. Furthermore, the data processing circuit 110 outputs the reference clock signal to the clock embedded control circuit 112 and outputs the first and the second data signals to the encode circuit 114. The first data signal includes first training data and first main image data, and the second data signal includes second training data and second main image data. It can be understood, the first data signal can be provided to the encode circuit 114 before the second data signal. In one embodiment, the data processing circuit 110 outputs the first data signal and the second data signal to the encode circuit 114 in series.

The clock embedded control circuit 112 receives the reference clock signal and generates a first clock signal and a second clock signal according to the reference clock signal. A frequency of the first clock signal is different from a frequency of the second clock signal. In one embodiment, a frequency of the reference clock signal is defined as "f", and each of the frequencies of the first clock signal and the second clock signal is in the range from f*90% to f*110%. Furthermore, the clock embedded control circuit 112 also generates a first clock training control signal and a second clock training control signal and outputs the first clock signal, the second clock signal, the first clock training control signal, and the second clock training control signal to the encode circuit 114. It can be understood, the first clock signal can be provided to the encode circuit 114 before the second clock signal, and the first clock training control signal can be provided to the encode circuit 114 before the second clock training control signal. In one embodiment, the clock embedded control circuit 112 outputs the first clock signal and the second clock signal to the encode circuit 114 in series, and the clock embedded control circuit 112 outputs the first clock training control signal and the second clock training control signal to the encode circuit 114 in series.

The encode circuit 114 receives the first data signal, the second data signal, the first clock signal, the second clock signal, the first clock training control signal, and the second clock training control signal. Specially, the encode circuit 114 embeds the first clock signal into the first training data to obtain a first clock embedded training data and outputs the first clock embedded training data to the data driving circuit 12 under the controls of the first clock training control signal. The data driving circuit 12 receives the first clock embedded training data and performs a first clock training to adjust a work frequency of the data driving circuit 12 to be equal to the frequency of the first clock signal. When the work frequency of the data driving circuit 12 is equal to the frequency of the first clock signal by the first clock training, the data driving circuit outputs a first feedback signal to the clock embedded control circuit 112, and the clock embedded control circuit 112 stops to output the first clock training control signal. Then, the encode circuit 114 embeds the first clock signal into the first main image data to obtain a first clock embedded image data and outputs the first clock embedded image data to the data driving circuit 12, such that the data driving circuit 12 receives the first clock embedded image data in a frequency same as the frequency of the first clock signal. When the data driving circuit 12 receives the first clock embedded image data, the data driving circuit 12 decodes the first clock embedded image data to obtain the first clock signal and the first main image data. The data driving circuit 12 detects a timing of the first main image data according to the first clock signal and corrects the timing of the first main image data when the timing of the first main image data are wrong. Further, the data driving circuit 12 also converts the first main image data into first data voltages and outputs the first data voltages to the display panel 13, such that the display panel 13 displays image.

The display panel 13 includes display periods and dummy periods each located between two adjacent display periods, and the display panel 13 displays a corresponding frame of image in each display period. The first main image data correspond to the display periods, that is, the display panel 13 displays normal images according to the first data voltages in the display period. Furthermore, the data driving circuit 12 decodes the first clock embedded training data to obtain the first training data and converts the first training data into dummy data voltages. The first training data correspond to the dummy periods, that is, the data driving circuit 12 outputs the dummy data voltages into the display panel 13 in dummy periods, and the display panel 13 displays dummy images in dummy periods.

After the data driving circuit 12 receives the first clock embedded image data, that is, a transmission of the first clock embedded image data are finished, the encode circuit 114 embeds the second clock signal into the second training data to obtain a second clock embedded training data and outputs the second clock embedded training data to the data driving circuit 12 under the controls of the second clock training control signal. The data driving circuit 12 receives the second clock embedded training data and performs a second clock training to adjust a work frequency of the data driving circuit 12 to be equal to the frequency of the second clock signal. When the work frequency of the data driving circuit 12 is equal to the frequency of the second clock signal by the second clock training, the data driving circuit outputs a second feedback signal to the clock embedded control circuit 112, and the clock embedded control circuit 112 stops to output the second clock training control signal. Then, the encode circuit 114 embeds the second clock signal into the second main image data to obtain a second clock embedded image data and outputs the second clock embedded image data to the data driving circuit 12, such that the data driving circuit 12 receives the second clock embedded image data in a frequency same as the frequency of the second clock signal. The data driving circuit 12 detects a timing of the second main image data according to the second clock signal and corrects the timing of the second main image data when the timing of the second main image data are wrong. Further, the data driving circuit 12 also converts the second main image data into second data voltages and outputs the second data voltages to the display panel 13, such that the display panel 13 displays image.

In one embodiment, the second main image data also correspond to the display periods, that is, the display panel 13 displays normal images according to the second data voltages in the display periods. The second main image data correspond to the display periods, that is, the display panel 13 displays normal images according to the second data voltages in the display period. Furthermore, the data driving circuit 12 decodes the second clock embedded training data to obtain the second training data and converts the second training data into dummy data voltages. The second training data correspond to the dummy periods, that is, the data driving circuit 12 outputs the dummy data voltages into the display panel 13 in dummy periods, and the display panel 13 displays dummy images in dummy periods.

It can be understood, the encode circuit 114 outputs the first clock embedded training data, the first clock embedded image data, the second clock embedded training data, and the second clock embedded image data to the data driving circuit 12 in series. The data driving circuit 12 outputs the dummy data voltages corresponding to the first training data, the first data voltages corresponding to the first main image data, the dummy data voltages corresponding to the second training data, and the second data voltages corresponding to the first main image data to the display panels 13 in series. The display panels 13 displays the dummy image corresponding to the first training data, a first frame of image corresponding to the first main image data, the dummy image corresponding to the second training data, a second frame of image corresponding to the second main image data.

It also can be understood, in one embodiment, the clock embedded control circuit 112 may output the first clock training control signal and the second clock training control signal alternately. To define the first clock embedded training data and the first clock embedded image data as a first clock embedded data, and to define the second clock embedded training data and the second clock embedded image data as a second clock embedded data, the encode circuit 114 outputs the first clock embedded data and the second clock embedded data to the data driving circuit 12 alternately under the controls of the first clock training control signal and the second clock training control signal.

Furthermore, as FIG. 1 shown, in an alternating embodiment, after the encode circuit 114 outputs the second clock embedded image data, the clock embedded control circuit 112 generates a third clock signal and a fourth clock signal according to the reference clock signal. The first clock signal, the second clock signal, the third clock signal, and the fourth clock signal have four different frequencies, and a frequency of each of the first clock signal, the second clock signal, the third clock signal, and the fourth clock signal is in the range from f*90% to f*110%. In detail, the clock embedded control circuit 112 outputs the first clock signal, the second clock signal, the third clock signal and the fourth clock signal to the encode circuit 114 in series, and the clock embedded control circuit 112 outputs the first clock training control signal, the second clock training control signal, third clock training control signal and the fourth clock training control signal to the encode circuit 114 in series.

The data processing circuit 110 also decodes the display data to obtain a third data signal and a fourth data signal and outputs the third and the fourth data signals to the encode circuit 114. The third data signal includes third training data and third main image data, and the fourth data signal includes fourth training data and fourth main image data. In one embodiment, the data processing circuit 110 outputs the third data signal and the fourth data signal to the encode circuit 114 in series.

The encode circuit 114 receives the third data signal, the fourth data signal, the third clock signal, the fourth clock signal, the third clock training control signal, and the fourth clock training control signal, and the encode circuit 114 embeds the third clock signal into the third training data to obtain a third clock embedded training data and outputs the third clock embedded training data to the data driving circuit 12 under the controls of the third clock training control signal. The data driving circuit 12 receives the third clock embedded training data and performs a third clock training to adjust a work frequency of the data driving circuit 12 to be equal to the frequency of the third clock signal. When the work frequency of the data driving circuit 12 is equal to the frequency of the third clock signal by the third clock training, the data driving circuit outputs a third feedback signal to the clock embedded control circuit 112, and the clock embedded control circuit 112 stops to output the third clock training control signal. Then, the encode circuit 114 embeds the third clock signal into the third main image data to obtain a third clock embedded image data and outputs the third clock embedded image data to the data driving circuit 12, such that the data driving circuit 12 receives the third clock embedded image data in a frequency same as the frequency of the third clock signal. When the data driving circuit 12 receives the third clock embedded image data, the data driving circuit 12 decodes the third clock embedded image data to obtain the third clock signal and the third main image data. The data driving circuit 12 detects a timing of the third main image data according to the third clock signal and corrects the timing of the third main image data when the timing of the third main image data are wrong. Further, the data driving circuit 12 also converts the third main image data into third data voltages and outputs the third data voltages to the display panel 13, such that the display panel 13 displays image.

The third main image data correspond to the display periods, that is, the display panel 13 displays normal images according to the third data voltages in the display period. The third main image data correspond to the display periods, that is, the display panel 13 displays normal images according to the third data voltages in the display periods. Furthermore, the data driving circuit 12 decodes the third clock embedded training data to obtain the third training data and converts the third training data into dummy data voltages. The first training data correspond to the dummy periods, that is, the data driving circuit 12 outputs the dummy data voltages into the display panel 13 in dummy periods, and the display panel 13 displays dummy images in dummy periods.

After the data driving circuit 12 receives the third clock embedded image data, that is, a transmission of the third clock embedded image data are finished, the encode circuit 114 embeds the fourth clock signal into the fourth training data to obtain a fourth clock embedded training data and outputs the fourth clock embedded training data to the data driving circuit 12 under the controls of the fourth clock training control signal. The data driving circuit 12 receives the fourth clock embedded training data and performs a fourth clock training to adjust a work frequency of the data driving circuit 12 to be equal to the frequency of the fourth clock signal. When the work frequency of the data driving circuit 12 is equal to the frequency of the fourth clock signal by the fourth clock training, the data driving circuit 12 outputs a fourth feedback signal to the clock embedded control circuit 112, and the clock embedded control circuit 112 stops to output the fourth clock training control signal. Then, the encode circuit 114 embeds the fourth clock signal into the fourth main image data to obtain a fourth clock embedded image data and outputs the fourth clock embedded image data to the data driving circuit 12, such that the data driving circuit 12 receives the fourth clock embedded image data in the work frequency which is the same as the frequency of the fourth clock signal. The data driving circuit 12 detects a timing of the fourth main image data according to the fourth clock signal and corrects the timing of the fourth main image data when the timing of the fourth main image data are wrong. Further, the data driving circuit 12 also converts the fourth main image data into fourth data voltages and outputs the fourth data voltages to the display panel 13, such that the display panel 13 displays image.

In one embodiment, the fourth main image data also correspond to the display periods, that is, the display panel 13 displays normal images according to the fourth data voltages in the display periods. The fourth main image data correspond to the display periods, that is, the display panel 13 displays normal images according to the fourth data voltages in the display period. Furthermore, the data driving circuit 12 decodes the fourth clock embedded training data to obtain the fourth training data and converts the fourth training data into dummy data voltages. The fourth training data correspond to the dummy periods, that is, the data driving circuit 12 outputs the dummy data voltages into the display panel 13 in dummy periods, and the display panel 13 displays dummy images in dummy periods.

It can be understood, in the alternating embodiment, the encode circuit 114 outputs the first clock embedded training data, the first clock embedded image data, the second clock embedded training data, the second clock embedded image data, the third clock embedded training data, the third clock embedded image data, the fourth clock embedded training data, and the fourth clock embedded image data to the data driving circuit 12 in series. The data driving circuit 12 outputs the dummy data voltages corresponding to the first training data, the first data voltages corresponding to the first main image data, the dummy data voltages corresponding to the second training data, the second data voltages corresponding to the first main image data, the dummy data voltages corresponding to the third training data, the first data voltages corresponding to the first main image data, the dummy data voltages corresponding to the second training data, and the second data voltages corresponding to the first main image data to the display panels 13 in series. The display panels 13 displays the dummy image corresponding to the first training data, a first frame of image corresponding to the first main image data, the dummy image corresponding to the second training data, a second frame of image corresponding to the second main image data, the dummy image corresponding to the third training data, a third frame of image corresponding to the third main image data, the dummy image corresponding to the fourth training data, and a fourth frame of image corresponding to the fourth main image data.

In summary, the timing control circuit 11 transmits clock embedded data to the data driving circuit 12 in two or four different frequencies, EMI during data transmission can be reduced.

Figure 2:
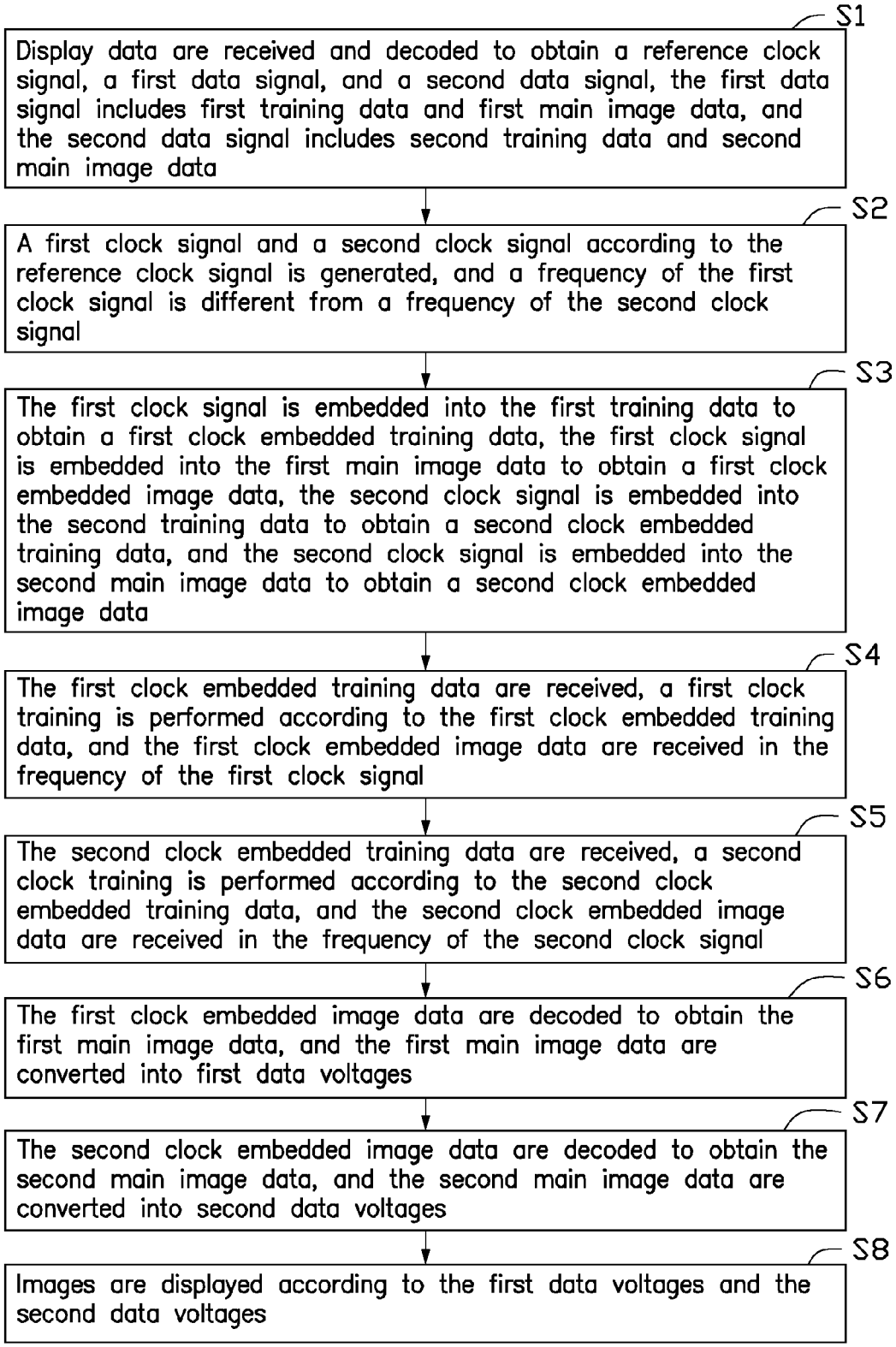
FIG. 2 is a flow chart of a driving method of the display device of FIG. 1 according to a first embodiment of present disclosure.

FIG. 2 show a flow chart of a driving method of the display device 10 of FIG. 1 according to a first embodiment of present disclosure. The driving method of the display device 10 includes the following steps S1~S8.

Step S1, display data are received and decoded to obtain a reference clock signal, a first data signal, and a second data signal by the data processing circuit 110, the first data signal includes first training data and first main image data, the second data signal includes second training data and second main image data.

Step S2, a first clock signal and a second clock signal according to the reference clock signal is generated by the clock embedded control circuit 112, and a frequency of the first clock signal is different from a frequency of the second clock signal. In one embodiment, a frequency of the reference clock signal is defined as "f", and each of the frequencies of the first clock signal and the second clock signal is in the range from f*90% to f*110%.

Step S3, the first clock signal is embedded into the first training data to obtain a first clock embedded training data, the first clock signal is embedded into the first main image data to obtain a first clock embedded image data, the second clock signal is embedded into the second training data to obtain a second clock embedded training data, and the second clock signal is embedded into the second main image data to obtain a second clock embedded image data, by the encode circuit 114.

Step S4, the first clock embedded training data are received, a first clock training is performed according to the first clock embedded training data, and the first clock embedded image data are received in the frequency of the first clock signal, by the data driving circuit 12. Furthermore, in the Step S4, a timing of the first main image data is detected according to the first clock signal and corrected when the timing of the first main image data are wrong.

Step S5, the second clock embedded training data are received, a second clock training is performed according to the second clock embedded training data, and the second clock embedded image data are received in the frequency of the second clock signal, by the data driving circuit 12. Furthermore, in the Step S5, a timing of the second main image data is detected according to the second clock signal and corrected when the timing of the second main image data are wrong.

Step S6, the first clock embedded image data are decoded to obtain the first main image data, and the first main image data are converted into first data voltages, by the data driving circuit 12.

Step S7, the second clock embedded image data are decoded to obtain the second main image data, and the second main image data are converted into second data voltages, by the data driving circuit 12.

Step S8, images are displayed according to the first data voltages and the second data voltages, by the display panel 13.

Figure 3:
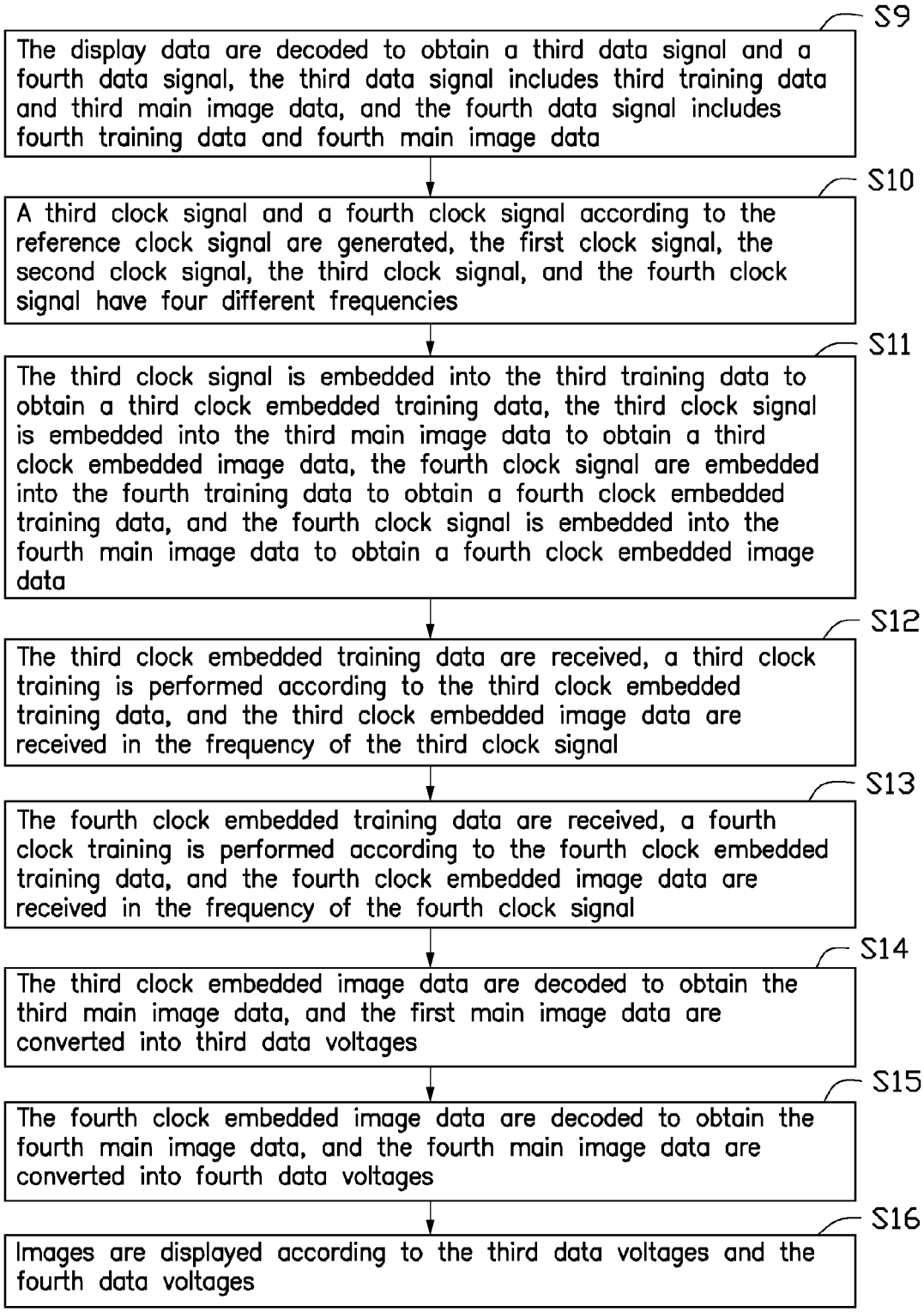
FIG. 3 is a flow chart of a driving method of the display device of FIG. 1 according to a second embodiment of present disclosure.

FIG. 3 show a flow chart of a driving method of the display device of FIG. 1 according to a second embodiment of present disclosure. The method as illustrated in FIG. 3 is similar to the method as illustrated in FIG. 2, but differs in that the method further includes steps S9~S16 as described below.

Step S9, the display data are decoded to obtain a third data signal and a fourth data signal by the data processing circuit 110, the third data signal includes third training data and third main image data, the fourth data signal includes fourth training data and fourth main image data.

Step S10, a third clock signal and a fourth clock signal according to the reference clock signal are generated by the clock embedded control circuit 112, the first clock signal, the second clock signal, the third clock signal, and the fourth clock signal have four different frequencies.

Step S11, the third clock signal is embedded into the third training data to obtain a third clock embedded training data, the third clock signal is embedded into the third main image data to obtain a third clock embedded image data, the fourth clock signal are embedded into the fourth training data to obtain a fourth clock embedded training data, and the fourth clock signal is embedded into the fourth main image data to obtain a fourth clock embedded image data, by the encode circuit 114.

Step S12, the third clock embedded training data are received, a third clock training is performed according to the third clock embedded training data, and the third clock embedded image data are received in the frequency of the third clock signal, by the data driving circuit 12.

Step S13, the fourth clock embedded training data are received, a fourth clock training is performed according to the fourth clock embedded training data, and the fourth clock embedded image data are received in the frequency of the fourth clock signal, by the data driving circuit 12.

Step S14, the third clock embedded image data are decoded to obtain the third main image data, and the first main image data are converted into third data voltages, by the data driving circuit 12.

Step S15, the fourth clock embedded image data are decoded to obtain the fourth main image data, and the fourth main image data are converted into fourth data voltages, by the data driving circuit 12.

Step S16, images are displayed according to the third data voltages and the fourth data voltages, by the display panel 13.

Figure 4:
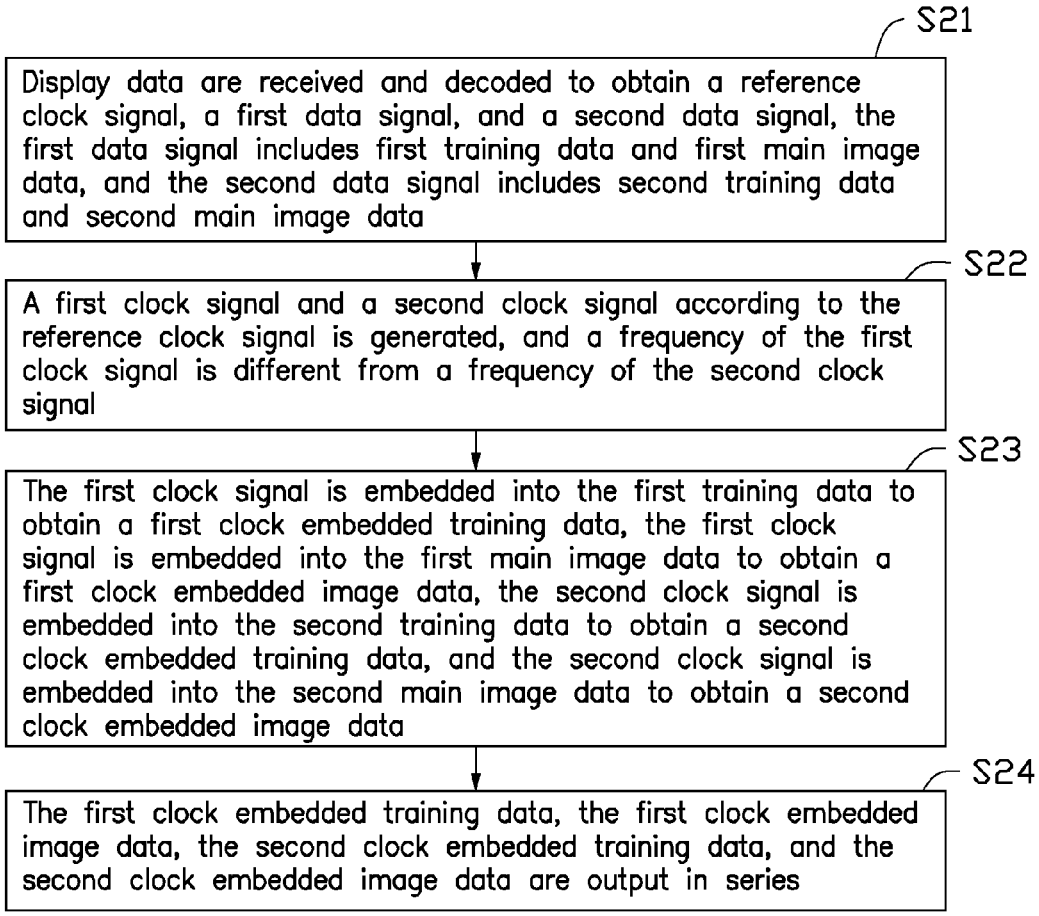
FIG. 4 shows a flow chart of a data processing and outputting method of a timing control circuit according to an exemplary embodiment of present disclosure.

FIG. 4 shows a flow chart of a data processing and outputting method of a timing control circuit 12 according to an exemplary embodiment of present disclosure. The data processing and outputting method of a timing control circuit 12 includes the following steps S21~S24.

Step S21, display data are received and decoded to obtain a reference clock signal, a first data signal, and a second data signal by the data processing circuit 110, the first data signal includes first training data and first main image data, the second data signal includes second training data and second main image data.

Step S22, a first clock signal and a second clock signal according to the reference clock signal is generated by the clock embedded control circuit 112, and a frequency of the first clock signal is different from a frequency of the second clock signal. In one embodiment, a frequency of the reference clock signal is defined as "f", and each of the frequencies of the first clock signal and the second clock signal is in the range from f*90% to f*110%.

Step S23, the first clock signal is embedded into the first training data to obtain a first clock embedded training data, the first clock signal is embedded into the first main image data to obtain a first clock embedded image data, the second clock signal is embedded into the second training data to obtain a second clock embedded training data, and the second clock signal is embedded into the second main image data to obtain a second clock embedded image data, by the encode circuit 114.

Step S24, the first clock embedded training data, the first clock embedded image data, the second clock embedded training data, and the second clock embedded image data are output by encode circuit 114 the in series.

Figure 5:
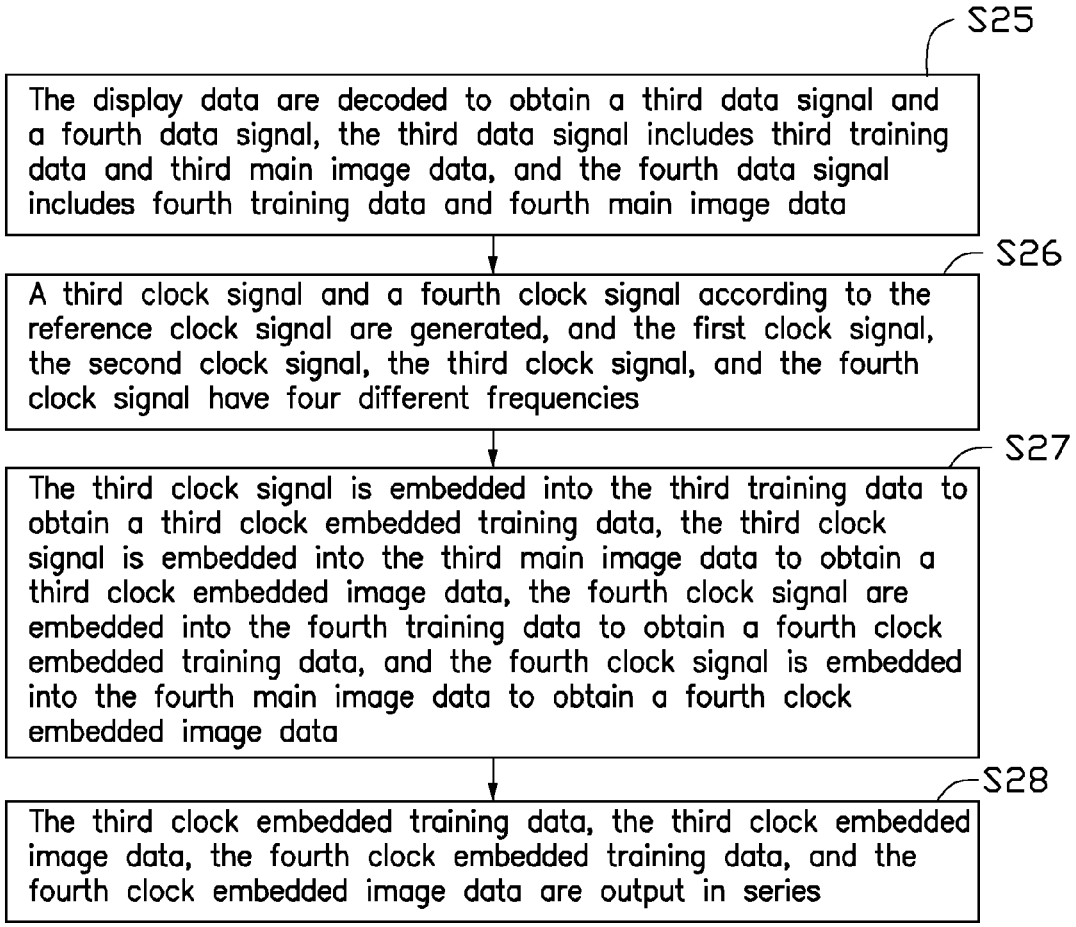
FIG. 5 shows a flow chart of a data processing and outputting method of a timing control circuit according to an alternating embodiment of present disclosure.

In alternating embodiment, referring to FIG. 5, the data processing and outputting method of a timing control circuit 12 further includes the following steps S25~S28.

Step S25, the display data are decoded to obtain a third data signal and a fourth data signal by the data processing circuit 110, the third data signal includes third training data and third main image data, and the fourth data signal includes fourth training data and fourth main image data.

Step S26, a third clock signal and a fourth clock signal according to the reference clock signal are generated by the clock embedded control circuit 112, and the first clock signal, the second clock signal, the third clock signal, and the fourth clock signal have four different frequencies.

Step S27, the third clock signal is embedded into the third training data to obtain a third clock embedded training data, the third clock signal is embedded into the third main image data to obtain a third clock embedded image data, the fourth clock signal are embedded into the fourth training data to obtain a fourth clock embedded training data, and the fourth clock signal is embedded into the fourth main image data to obtain a fourth clock embedded image data, by the encode circuit 114.

Step S28, the third clock embedded training data, the third clock embedded image data, the fourth clock embedded training data, and the fourth clock embedded image data are output in series.

It is to be further understood that even though numerous characteristics and advantages of preferred and exemplary embodiments have been set out in the foregoing description, together with details of the structures and functions of the embodiments, the disclosure is illustrative only; and that changes may be made in detail, especially in matters of shape, size and arrangement of parts within the principles of the present disclosure to the full extent indicated by the broad general meaning of the terms in which the appended claims are expressed.

What is claimed is:

1. A display device, comprising:

a timing control circuit comprising:

a data processing circuit, the data processing circuit receiving display data and decoding the display data to obtain a reference clock signal, a first data signal, and a second data signal, the first data signal comprising first training data and first main image data, the second data signal comprising second training data and second main image data;

a clock embedded control circuit receiving the reference clock signal and generating a first clock signal and a second clock signal according to the reference clock signal, a frequency of the first clock signal being different from a frequency of the second clock signal; and an encode circuit receiving the first clock signal, the second clock signal, the first data signal, and the second data signal, and the encode circuit embedding the first clock signal into the first training data to obtain a first clock embedded training data, embedding the first clock signal into the first main image data to obtain a first clock embedded image data, embedding the second clock signal into the second training data to obtain a second clock embedded training data, and embedding the second clock signal into the second main image data to obtain a second clock embedded image data; and a data driving circuit receiving the first clock embedded training data, performing a first clock training to adjust a work frequency of the data driving circuit to be equal to the frequency of the first clock signal, and receiving the first clock embedded image data, and the data driving circuit receiving the second clock embedded training data, performing a second clock training to adjust a work frequency of the data driving circuit to be equal to the frequency of the second clock signal, and receiving the second clock embedded image data;

wherein the clock embedded control circuit also generates a first clock training control signal according to the reference clock signal and a second clock training control signal according to the reference clock signal, the encode circuit embeds the first clock signal into the first training data to obtain a first clock embedded training data under the controls of the first clock training control signal, the encode circuit also embeds the second clock signal into the second training data to obtain a second clock embedded training data under the controls of the second clock training control signal; the clock embedded control circuit outputs the first clock training control signal and the second clock training control signal alternately.

2. The display device of claim 1, wherein when the data driving circuit finishes the first clock training, the data driving circuit outputs a first feedback signal to the clock embedded control circuit, and the clock embedded control circuit stops to output the first clock training control signal according to the first feedback signal such that the encode circuit embeds the first clock signal into the first main image data to obtain the first clock embedded image data.

3. The display device of claim 2, wherein when the data driving circuit finishes the second clock training, the data driving circuit outputs a second feedback signal to the clock embedded control circuit, and the clock embedded control circuit stops to output the second clock training control signal according to the second feedback signal such that the encode circuit embeds the second clock signal into the second main image data to obtain the second clock embedded image data.

4. The display device of claim 3, further comprising a display panel, wherein the data driving circuit decodes the first clock embedded training data and the first clock embedded image data to obtain the first training data and the first main image data and converts the first training data and the first main image data into dummy data voltages and first data voltages, the display panel displays images according to the dummy data voltages and the first data voltages.

5. The display device of claim 4, wherein the data driving circuit decodes the second clock embedded training data and the second clock embedded image data to obtain the second training data and the second main image data and converts the second training data and the second main image data into dummy data voltages and second data voltages, the display panel further displays images according to the dummy data voltages and the second data voltages.

6. The display device of claim 5, wherein the display panel comprises display periods and dummy periods each located between two adjacent display periods, and the display panel displays a corresponding frame of image in each display period, the display panel displays normal images according to the first data voltages and the second data voltages in the display period, and the display panel displays dummy images in dummy periods according to the dummy data voltage.

7. The display device of claim 6, wherein the encode circuit outputs the first clock embedded training data, the first clock embedded image data, the second clock embedded training data, and the second clock embedded image data to the data driving circuit in series, the data driving circuit outputs the dummy data voltages corresponding to the first training data, and the first data voltages corresponding to the first main image data, the dummy data voltages corresponding to the second training data, and the second data voltages corresponding to the second main image data to the display panels in series.

8. The display device of claim 1, wherein a frequency of the reference clock signal is defined as "f", and each of the frequencies of the first clock signal and the second clock signal is in the range from f*90% to f*110%.

9. The display device of claim 1, wherein the data driving circuit detects a timing of the first main image data according to the first clock signal and corrects the timing of the first main image data when the timing of the first main image data are wrong, and the data driving circuit detects a timing of the second main image data according to the second clock signal and corrects the timing of the second main image data when the timing of the second main image data are wrong.

10. The display device of claim 1, wherein after the encode circuit outputs the second clock embedded image data, the clock embedded control circuit generates a third clock signal and a fourth clock signal according to the reference clock signal, the first clock signal, the frequencies of the second clock signal, the third clock signal, and the fourth clock signal are different from each other, the data processing circuit also decodes the display data to obtain a third data signal and a fourth data signal, the third data signal comprising third training data and third main image data, the fourth data signal comprising fourth training data and fourth main image data, the encode circuit embeds the third clock signal into the third training data to obtain a third clock embedded training data, embeds the third clock signal into the third main image data to obtain a third clock embedded image data, embeds the fourth clock signal into the fourth training data to obtain a fourth clock embedded training data, and embedding the fourth clock signal into the fourth main image data to obtain a fourth clock embedded image data, the data driving circuit receives the third clock embedded training data, performs a third clock training, and receives the third clock embedded image data in the frequency of the third clock signal, and the data driving circuit also receives the fourth clock embedded training data, performs a fourth clock training, and receives the fourth clock embedded image data in the frequency of the fourth clock signal.

11. A driving method of the display device, comprising:

receiving display data and decoding the display data to obtain a reference clock signal, a first data signal, and a second data signal, the first data signal comprising first training data and first main image data, the second data signal comprising second training data and second main image data;

generating a first clock signal and a second clock signal according to the reference clock signal, wherein a frequency of the first clock signal is different from a frequency of the second clock signal;

embedding the first clock signal into the first training data to obtain a first clock embedded training data, embedding the first clock signal into the first main image data to obtain a first clock embedded image data, embedding the second clock signal into the second training data to obtain a second clock embedded training data, and embedding the second clock signal into the second main image data to obtain a second clock embedded image data;

receiving the first clock embedded training data outputted by a control of a first clock training control signal, performing a first clock training according to the first clock embedded training data, and receiving the first clock embedded image data in the frequency of the first clock signal;

receiving the second clock embedded training data outputted by a control of a second clock training control signal, performing a second clock training according to the second clock embedded training data, and receiving the second clock embedded image data in the frequency of the second clock signal; wherein the second clock training control signal and the first clock training control signal are generated alternately;

decoding the first clock embedded image data to obtain the first main image data and converting the first main image data into first data voltages;

decoding the second clock embedded image data to obtain the second main image data and converting the second main image data into second data voltages; and displaying images according to the first data voltages and the second data voltages.

12. The method of claim 11, wherein a frequency of the reference clock signal is defined as "f", and each of the frequencies of the first clock signal and the second clock signal is in the range from f*90% to f*110%.

13. The method of claim 11, the method further comprising detecting a timing of the first main image data according to the first clock signal and correcting the timing of the first main image data when the timing of the first main image data are wrong; and detecting a timing of the second main image data according to the second clock signal and correcting the timing of the second main image data when the timing of the second main image data are wrong.

14. The method of claim 11, further comprising decoding the display data to obtain a third data signal and a fourth data signal, the third data signal comprising third training data and third main image data, the fourth data signal comprising fourth training data and fourth main image data, embedding the third clock signal into the third training data to obtain a third clock embedded training data, embedding the third clock signal into the third main image data to obtain a third clock embedded image data, embedding the fourth clock signal into the fourth training data to obtain a fourth clock embedded training data, and embedding the fourth clock signal into the fourth main image data to obtain a fourth clock embedded image data, receiving the third clock embedded training data, performing a third clock training, and receiving the third clock embedded image data in the frequency of the third clock signal, and receiving the fourth clock embedded training data, performing a fourth clock training, and receiving the fourth clock embedded image data in the frequency of the fourth clock signal.

15. A data processing and outputting method of a timing control circuit, comprising:

receiving display data and decoding the display data to obtain a reference clock signal, a first data signal, and a second data signal, the first data signal comprising first training data and first main image data, the second data signal comprising second training data and second main image data;

generating a first clock signal and a second clock signal according to the reference clock signal, wherein a frequency of the first clock signal is different from a frequency of the second clock signal;

embedding the first clock signal into the first training data to obtain a first clock embedded training data, embedding the first clock signal into the first main image data to obtain a first clock embedded image data, embedding the second clock signal into the second training data to obtain a second clock embedded training data, and embedding the second clock signal into the second main image data to obtain a second clock embedded image data; and outputting the first clock embedded training data by a control of a first clock training control signal, the first clock embedded image data, the second clock embedded training data by a control of a second clock training control signal, and the second clock embedded image data in series, wherein the second clock training control signal and the first clock training control signal are generated alternately.

16. The method of claim 15, wherein a frequency of the reference clock signal is defined as "f", and each of the frequencies of the first clock signal and the second clock signal is in the range from f*90% to f*110%.

17. The method of claim 15, further comprising generating a third clock signal and a fourth clock signal according to the reference clock signal, the first clock signal, the second clock signal, the third clock signal, and wherein the frequencies of the first clock signal, the second clock signal, the third clock signal, and the fourth clock signal are different from each other;

decoding the display data to obtain a third data signal and a fourth data signal, the third data signal comprising third training data and third main image data, the fourth data signal comprising fourth training data and fourth main image data, embedding the third clock signal into the third training data to obtain a third clock embedded training data, embedding the third clock signal into the third main image data to obtain a third clock embedded image data, embedding the fourth clock signal into the fourth training data to obtain a fourth clock embedded training data, and embedding the fourth clock signal into the fourth main image data to obtain a fourth clock embedded image data, and outputting the third clock embedded training data, the third clock embedded image data, the fourth clock embedded training data, and the fourth clock embedded image data in series.

* * * * *